US011705647B2

(12) United States Patent
Elmanfalouti et al.

(10) Patent No.: US 11,705,647 B2
(45) Date of Patent: Jul. 18, 2023

(54) ASSEMBLY OF AN ELECTRIC CABLE WITH A CABLE TERMINAL

(71) Applicant: APTIV TECHNOLOGIES LIMITED, St. Michael (BB)

(72) Inventors: Abdelaaziz Elmanfalouti, Elancourt (FR); Emilie Fretigny, Epernon (FR)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 4 days.

(21) Appl. No.: 17/543,252

(22) Filed: Dec. 6, 2021

(65) Prior Publication Data

US 2022/0190491 A1 Jun. 16, 2022

(30) Foreign Application Priority Data

Dec. 11, 2020 (FR) ..... 2013077

(51) Int. Cl.
*H01R 4/18* (2006.01)
*H01R 4/70* (2006.01)
*H01R 43/05* (2006.01)

(52) U.S. Cl.
CPC ..... *H01R 4/185* (2013.01); *H01R 4/70* (2013.01); *H01R 43/05* (2013.01)

(58) Field of Classification Search
CPC ..... H01R 4/185; H01R 4/70; H01R 43/05
USPC ..... 439/789
See application file for complete search history.

(56) References Cited

U.S. PATENT DOCUMENTS 3,555,171 A * 1/1971 Larson ..... H02G 15/013 277/622
4,356,343 A * 10/1982 Larson ..... H02G 15/043 174/74 A
5,824,962 A * 10/1998 Katsuma ..... H01R 13/5205 439/587
6,764,329 B2 * 7/2004 Noguchi ..... H01R 13/5205 439/587

(Continued)

FOREIGN PATENT DOCUMENTS

EP 0701300 A2 3/1996
EP 1160930 A1 12/2001
EP 2856568 B1 7/2018

OTHER PUBLICATIONS

French Search Report for French Application No. FR2013077 completed Aug. 24, 2021.

(Continued)

*Primary Examiner* — Peter G Leigh
(74) *Attorney, Agent, or Firm* — Carlson, Gaskey & Olds, P.C.

(57) ABSTRACT

Method for crimping a cable terminal onto an electric cable includes providing an electric cable having an outer insulation sheath and at least one conductive strand with a sheathed portion, and providing a terminal having shrink wings and provide a gasket having a sealing portion and a shrink portion. The method also includes stripping the electrical cable so that a stripped portion is formed, positioning the shrinkage portion of the joint so that it directly overlaps the stripped portion of the cable without the shrinkage portion overlapping the sheathed portion of the cable, and fully crimping the shrink wings onto the shrink portion of the joint without the shrink wings covering the sheathed portion of the cable.

8 Claims, 3 Drawing Sheets

(56) References Cited

U.S. PATENT DOCUMENTS

| | | | | |
|---|---|---|---|---|
| 6,840,804 | B2 * | 1/2005 | Murakami | H01R 13/5205 439/587 |
| 7,147,500 | B2 * | 12/2006 | Tabata | H01R 13/5205 439/274 |
| 7,997,916 | B2 * | 8/2011 | Yoshioka | H01R 13/5205 439/271 |
| 9,065,261 | B2 * | 6/2015 | Kawamura | H01R 43/24 |
| 10,355,395 | B2 * | 7/2019 | Hashimoto | H01R 11/11 |
| 2002/0171207 | A1 * | 11/2002 | Torii | H01R 13/5205 277/607 |
| 2004/0106316 | A1 | 6/2004 | Noguchi et al. | |

OTHER PUBLICATIONS

European Search Report for European Application No. 21213427.4 dated Apr. 11, 2022.

* cited by examiner

[Fig 1]
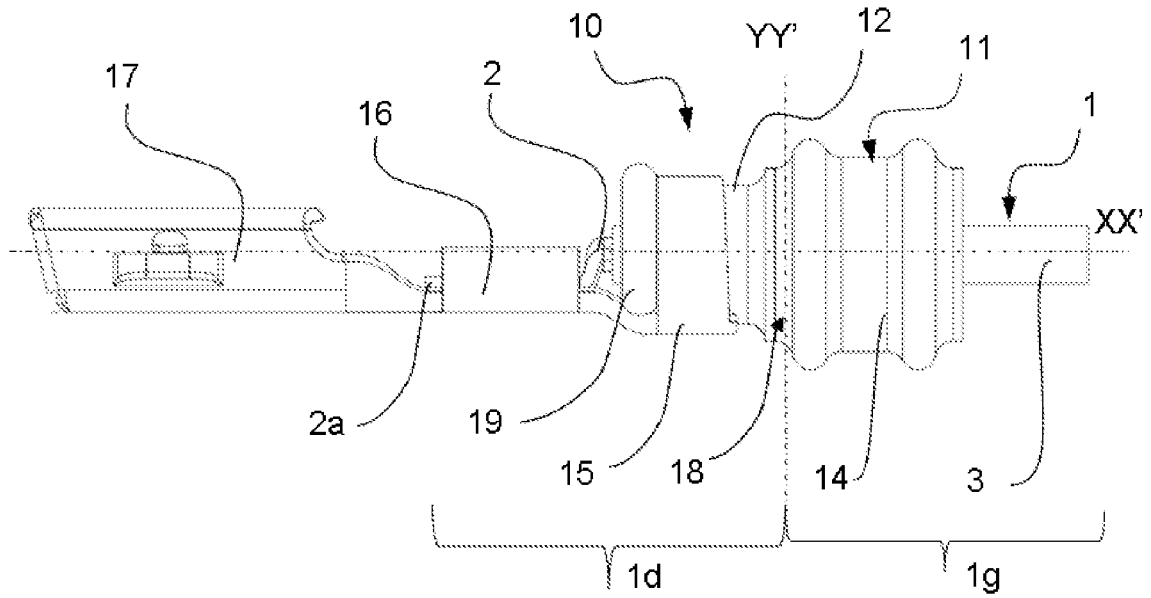
[Fig 2]
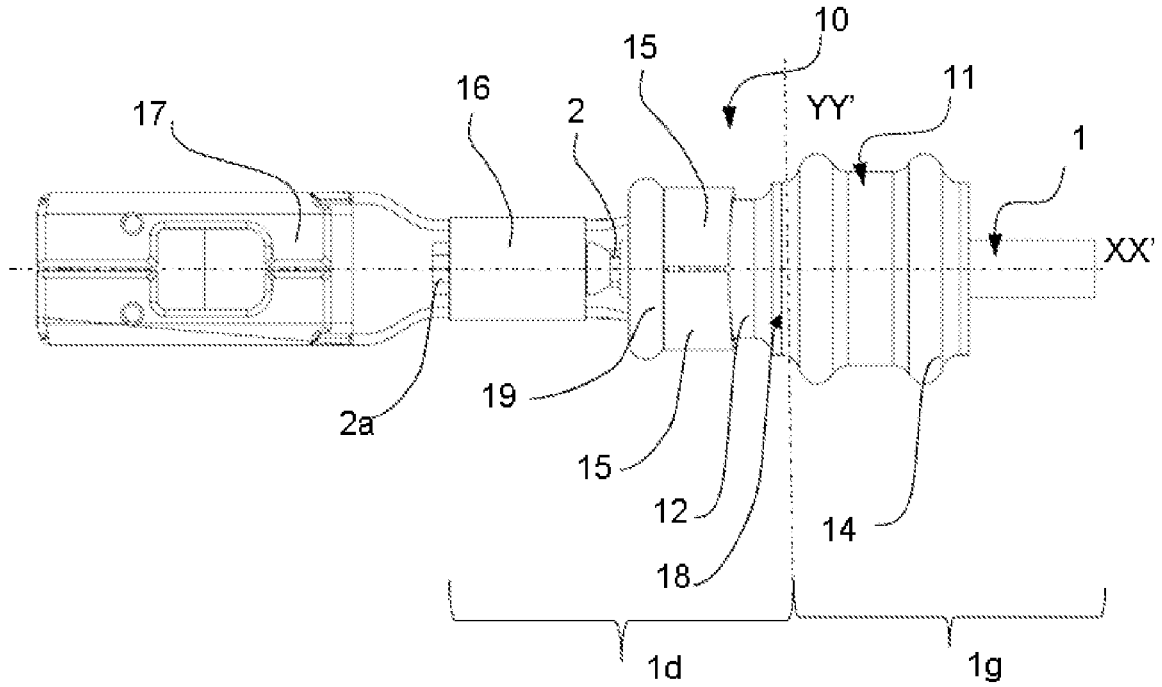

[Fig 3]
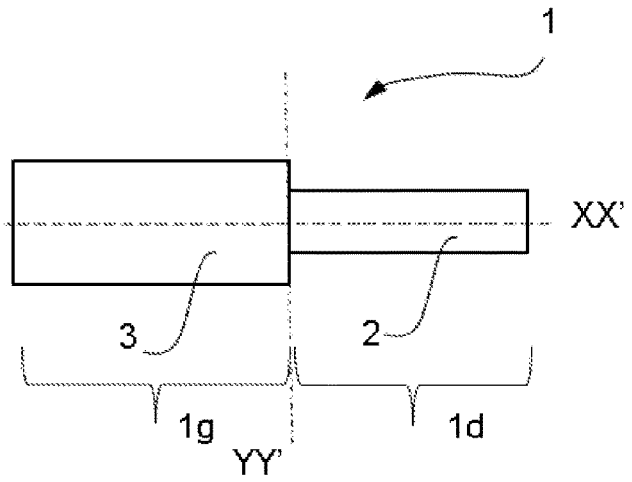
[Fig 4]
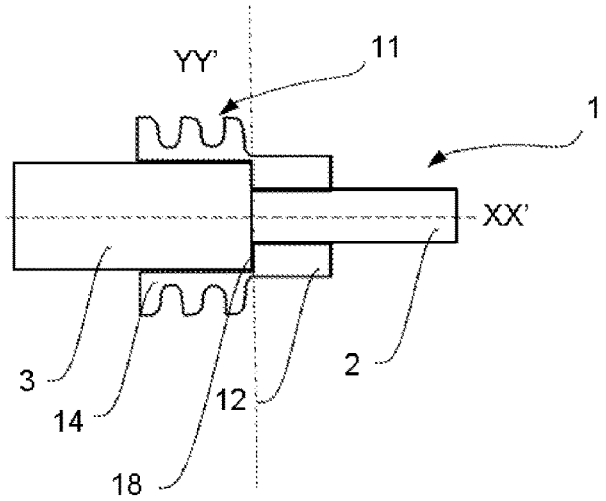
[Fig 5]
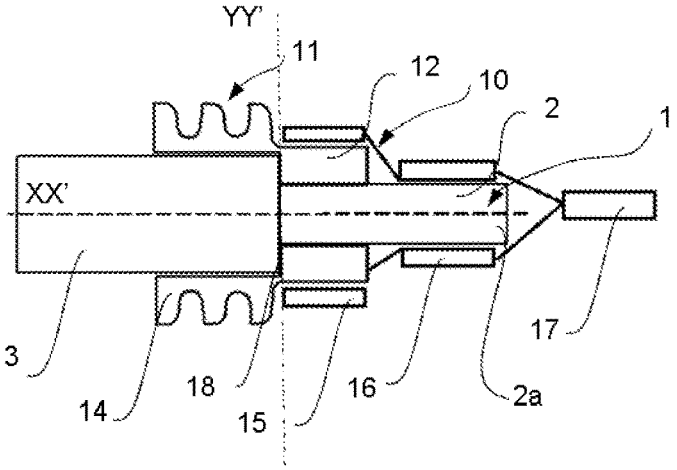

[Fig 6]
PRIOR ART
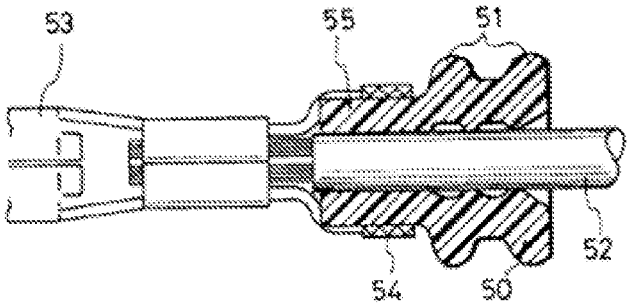
[Fig 7]
PRIOR ART
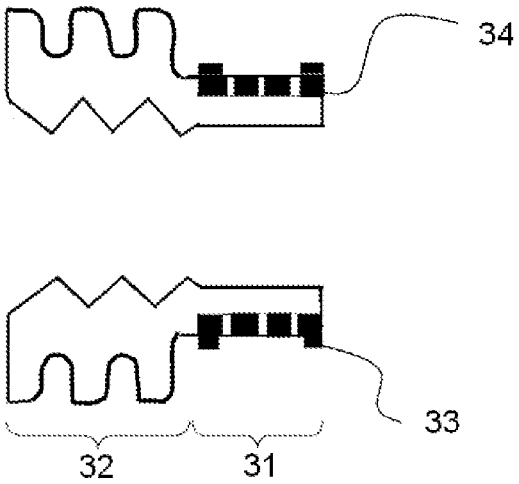

ASSEMBLY OF AN ELECTRIC CABLE WITH A CABLE TERMINAL

CROSS-REFERENCE TO RELATED APPLICATIONS

This application claims priority to French Patent Application No. FR2013077 filed on Dec. 11, 2020.

TECHNICAL FIELD

This description relates in a general way to an electrical cable terminal assembly, for example in the field of connectors and electrical cables in a motor vehicle.

BACKGROUND

In many applications, it is necessary to mount electrical cables on terminals or connector housings and to make the connection moisture- or dust-tight, etc. In many applications, it is necessary to mount electrical cables on terminals or connector housings and to make the connection moisture- or dust-tight, etc. For this purpose, seals are used, which are placed on the cable sheath and seal between the cable and the inner walls of the terminal or connector housing.

An assembly with an electrical cable terminal, as disclosed in U.S. Pat. No. 5,824,962, is known in the prior art. The conventional rubber gasket consists of a first part with sealing lips that provide a sealing function, and a second part is adapted to be attached to the sheathed wire. Specifically, an insulating piece of the metal terminal is forcibly deformed to surround the rubber gasket around the entire periphery of the sheathed wire, thereby securing the rubber gasket to the sheathed wire. In addition, an intermediate piece is interlaced on the peripheral surface of the gasket.

On the other hand, the assembly of the anterior artwork above has the disadvantage of having an interface part, which makes the assembly more expensive and more complex to manufacture. In addition, the assembly of the anterior artwork cannot adapt to several cable diameters and does not ensure a good fixation of the joint on the electrical wire.

In addition, since the known joints are made of an elastic material, crimping can lead to severe deformation of the joint. These deformations not only impair the sealing properties, but also result in the minimum tensile force requirements between the joint and the electrical wire no longer being met. For example, loosening of the crimped connection between the electrical cable and the gasket can occur when handling the cable or when pulling the crimped terminal (e.g. out of a housing).

In addition, document EP2856568B1 discloses a seal. The gasket consists of a sealing portion and a shrinkage portion, with an additional reinforcing element cooperating with a flange. The reinforcement element improves the crimp, "protects" the gasket during crimping and reduces deformation of the relatively soft gasket. However, the reinforcement element is an additional part that adds to the cost of the gasket and makes it more complex to manufacture.

SUMMARY OF THE DISCLOSURE

A purpose of this disclosure is to address the above-mentioned drawbacks of the prior art and to improve cable terminal assemblies and in particular, first, to propose an assembly of an electrical cable and a cable terminal, the cable having an outer sheath of insulation and at least one conductive strand, and having a sheathed portion and a bare portion, the assembly further having a seal with a sealing portion and a shrinkage portion, the terminal having cargo wings, and in which the sealing portion of the joint is assembled over the sheathed portion of the cable, and the shrinking portion of the joint is assembled directly over the stripped portion of the cable, and the shrinking wings are fully assembled over the shrinking portion of the joint.

This makes it possible to propose a cable terminal assembly that can be adapted to different diameters of electric cable while ensuring good assembly and fixing of the terminal on the cable, especially in traction. In addition, it prevents injury to the cable during assembly, and prevents injury to the joint, thus ensuring a good seal and secure fastening. In addition, it reduces the number of parts and facilitates assembly and manufacturing, thus reducing manufacturing costs. The assembly is thus adaptable to different rope diameters.

A sheathed or insulated portion is defined as a portion of the cable in which the outer insulation jacket partially or completely covers at least one conductive strand, and a bare portion is defined as a portion of the cable in which the outer insulation jacket does not cover at least one conductive strand. Cable terminal means a cable connector arranged to be connected to another cable connector, of the same or another cable. In one example, the cable has a plurality of conductive strands.

Advantageously, the crimping wings are arranged to crimp (or allow crimping of) the joint at the crimping portion, so as to pinch it vigorously (i.e. firmly).

Advantageously, the shrink wings do not overlap when crimped onto the shrink portion of the joint. In other words, the shrink wings are not juxtaposed (also called "0" shrinkage). This improves the attachment of the shrink wings to the joint, so that the entire shrink wings are in contact with the joint.

In an example design, the shrinkage portion has a shoulder arranged to abut against the sheathed portion of the cable. This ensures the precise positioning of the joint on the wire rope and thus provides a better fixation, while facilitating fabrication.

Advantageously, the cable terminal also has a male distal part or a female distal part. This allows the cable terminal to be connected to another cable terminal having the compatible distal part, and to connect two cable ends together (i.e. two cables, or the same coiled cable). Thus, a first terminal having a male distal part can be connected to a second terminal having a female distal part.

This disclosure also covers a process for crimping a cable terminal to an electrical cable, including providing an electric cable having an outer insulation sheath and at least one conductive strand with a sheathed portion, and providing a terminal having shrink wings and provide a gasket having a sealing portion and a shrink portion. The method also includes stripping the electrical cable so that a stripped portion is formed, positioning the shrinkage portion of the joint so that it directly overlaps the stripped portion of the cable without the shrinkage portion overlapping the sheathed portion of the cable, and fully crimping the shrink wings onto the shrink portion of the joint without the shrink wings covering the sheathed portion of the cable.

Advantageously, the stripped portion is increased, i.e., it has a significant length that is greater than the stripped portion of a conventional cable and/or greater than the shrink portion of the joint.

Advantageously, the step of stripping the electrical cable to form a stripped portion can be replaced by the step of providing the electrical cable with the stripped portion. This provides an easy to use crimping process (or shrink process) that improves the fixation and hold of the cable terminal to the cable without injuring either the terminal or the cable, thus improving the life of both. In addition, it allows the same terminal model to be adapted to different electrical cables of different diameters. This means that an existing known seal can be used and crimped with the new crimping process described. In other words, this makes it possible to use an existing seal and apply the cable terminal crimping procedure to the electrical cable using an existing seal. This also ensures that the crimping portion is not injured.

Advantageously, the process also has a step of positioning the sealing portion of the gasket at the sheathed portion of the cable without the sealing portion of the gasket covering the bare portion of the cable. This ensures better fastening of the terminal to the cable.

Advantageously, the process has a step of fully crimp the shrink wings onto the shrink portion of the joint without overlapping the shrink wings. This ensures that the terminal is securely fastened to the cable.

Advantageously, the process also has a step of abutting one shoulder of the shrinking portion of the joint on the sheathed portion of the cable. This ensures that the terminal is correctly positioned before crimping.

BRIEF DESCRIPTION OF THE DRAWINGS

Other characteristics and advantages of the present description will become clearer when reading the following detailed description of a given mode of realization as a non-limitative example and illustrated by the annexed drawings, in which:

FIG. 1 represents a side view of an assembly of an electric cable and a cable terminal according to this description, FIG. 2 represents a top view of the assembly as described here, FIG. 3 is a schematic representation of an electric cable and the crimping process according to this description.

FIG. 4 shows a schematic representation of the process with additional steps, FIG. 5 shows the schematic representation of the process with additional steps, FIG. 6 represents an assembly according to the previous art, FIG. 7 represents a joint according to the previous art.

DETAILED DESCRIPTION

FIG. 1 is a side view of an assembly of an electrical cable and a cable terminal as described here. A cable 1 has an outer insulation sheath 3 and a plurality of conductive strands 2 with a sheathed portion 1*g* of cable 1 and a stripped portion 1*d* of cable 1. Cable 1 has a longitudinal axis XX'. A YY' axis is shown to delineate the sheathed portion 1*g* of cable 1 and the stripped portion 1*d* of cable 1. The outer insulation sheath 3 is, for example, made of plastic and the conductive strands 2 are made of a conductive material such as copper, for example. In one particular design, the outer diameter of sheath 3 is 4.8 mm (or between 4 and 5 mm) and the inner diameter of sheath 3 is 3.2 mm (or between 3 and 4 mm). The conductive strands 2 each have a diameter of 0.32 mm (or between 0.25 mm and 0.35 mm). Note that the conductive strands 2 may have a different diameter.

The assembly of power cable 1 with a power cable terminal 10 is shown. Terminal 10 has shrinkage wings 15. The assembly further has a gasket 11 having a sealing portion 14 and a shrinkage portion 12, wherein the sealing portion 14 of gasket 11 is assembled on the sheathed portion 1*g* of cable 1, and the shrinkage portion 12 of gasket 11 is assembled directly on the stripped portion 1*d* of cable 1. The shrinkage wings 15 are fully assembled on the shrinkage portion 12 of gasket 11. Joint 11 is rotationally symmetrical and can easily be manufactured using a two-component molding process.

In an example design, gasket 11 is made of a plastic material, in particular silicone. The sealing portion 14 has waves on its outer diameter, which vary between 4.25 mm and 7.2 mm. Shrinkage portion 12 has a smaller diameter than sealing portion 14. Shrinkage portion 12 may have a diameter of 2.3 mm (or between 2 and 3 mm). Shrinkage portion 12 can be 3.2 mm long and the sealing portion can be 4.3 mm long.

The shrinkage wings 15 are made of metal, for example, steel, and are connected to a second shrinkage portion 16 directly crimped or pinched on the conductive strands 2. The second shrinkage portion 16 is connected to a distal part 17, which can be male or female, so as to connect terminal 10 to another compatible distal part 17 of another terminal 10. The second shrinkage portion 16 and the distal part 17 are made of a conductive material, for example, steel. The second shrinkage portion 16, when crimped onto the conductive strands 2, leaves a short end 2*a* of the conductive strands 2. Thus, an electrical current can flow from the conductive strands 2 of cable 1 to the distal part 17.

The shrinkage portion 12 of gasket 11 is positioned on the stripped portion 1*d* of cable 1, so that it is in direct contact with the conductive strands 2. The shrinkage wings 15 are then clamped onto the shrinkage portion 12 of gasket 11, and closed on shrinkage portion 12, without the shrinkage wings 15 touching each other. The example two 15-strand wings will then fully contact the 12-strand portion of gasket 11, but will not be placed next to each other. A gap of 0.2 mm may thus be present between the shrinkage wing 15 at their distal end, when closed.

In one example, gasket 11 has an internal shoulder 18 (shown schematically in FIG. 4) so that it abuts the sheathed portion 1*g* of cable 1 when assembling gasket 11 to cable 1. This ensures the correct positioning of gasket 11 on cable 1, and the correct alignment of the shrinkage portion 12 on the stripped portion 1*d* of cable 1. Thus, when crimping the shrinkage wings 15 onto the shrinkage portion 12 of gasket 11, the correct attachment of terminal 10 to cable 1 via gasket 11 is ensured, and gasket 11 is not injured (e.g. by incorrect positioning of the shrinkage wings 15).

The shoulder 18 is made at the diameter change between the shrinkage portion 12 and the sealing portion 14 of gasket 11, so that it faces the sheathed portion 1*g* when inserting gasket 11 into cable 1 from the stripped portion 1*d* along the longitudinal axis XX'. Thus, shoulder 18 abuts the sheathed portion 1*g* at the YY' axis. Gasket 11 also has a collar 19, so that it guides the shrinkage wings 15, especially during crimping and after crimping.

FIG. 2 shows a top view of the assembly. The reference signs are kept as much as possible in relation to FIG. 1. The space between the shrinkage wings 15 is thus visible on the top view. Thus, in one example mode of fabrication, the shrinkage wings 15 cover 98% of the shrinkage portion 12 of gasket 11. In addition, the crimping of the second shrinkage portion 16 on the conductive strands 2 is shown, as well as the end 2*a* of the conductive strands 2.

FIG. 3 shows a schematic representation of an electrical cable and the crimping process according to this description. Cable 1 is supplied with the stripped portion 1*d* in which the conductive strands 2 are exposed and bare, and the sheathed portion 1*g* in which the conductive strands 2 are insulated and covered by the outer insulation sheath 3. The stripped portion 1*d* is stripped so as to form a increased stripped portion, for example. In other words, the inner peripheral surface of the shrinkage portion 12 will be entirely in contact with the stripped portion 1*d* when assembled.

FIG. 4 shows the schematic representation of the process with additional steps. The gasket 11 is supplied and inserted into the end of cable 1, from the stripped portion 1*d*. The shrinkage portion 12 of gasket 11 is positioned so that the inner peripheral surface of shrinkage portion 12 is directly and completely in contact with the stripped portion 1*d* of cable 1 without shrinkage portion 12 covering the sheathed portion 1*g* of cable 1. The sealing portion 14 of gasket 11 is thus positioned at the sheathed portion 1*g* of cable 1 without the sealing portion 14 of gasket 11 covering the stripped portion 1*d* of cable 1.

The process may have the additional step of abutting the shoulder 18 of the shrinkage portion 12 of gasket 11 on the sheathed portion 1*g* of cable 1 at the YY' axis. This ensures the correct positioning of gasket 11 of terminal 10.

FIG. 5 shows the schematic representation of the process with further steps. The step of providing the terminal 10 having the shrinkage wings 15 and providing the gasket 11 having the sealing portion 14 and a shrinkage portion 12 is divided into sub-steps of first providing the gasket 11 with the sealing portion 14 and the shrinkage portion 12, and then providing the shrinkage wings 15 coming in one piece with the second shrinkage portion 16 and the distal part 17.

The next step is to completely crimp the shrinkage wings 15 onto the shrinkage portion 12 of gasket 11 without the shrinkage wings 15 covering the sheathed portion 1*g* of cable 1. This ensures that the shrinkage portion 12 is not injured during crimping.

In addition, the entire crimping of the shrinkage wings 15 to the shrinkage portion 12 of gasket 11 is carried out without the shrinkage wings 15 overlapping. The crimping step of the second shrinkage portion 16 on the conductive strands 2 is also performed.

It is possible to supply power cable 1 directly with the increased stripped portion 1*d*, i.e. the step of stripping power cable 1 is carried out directly with the correct rib. In other words, the stripped portion 1*d* is directly with the correct stripped dimension.

FIG. 6 shows an assembly according to the previous art, as described in U.S. Pat. No. 5,824,962. The conventional rubber gasket 50 consists of a first part with sealing lips 51 that provide a sealing function, and a second part 55 is adapted to be attached to the sheathed wire 52. Specifically, an insulating piece 54 of the metal terminal 53 is forcibly deformed to surround the rubber gasket around the entire periphery of the sheathed wire 52, thereby attaching the rubber gasket to the wire 52. In addition, an intermediate piece is interlaced on the peripheral surface of the gasket at the attachment point.

FIG. 7 shows a gasket according to the prior art as described in EP2856568B1. The gasket consists of a sealing portion 32 and a shrinkage portion 31, with an additional reinforcement element 34 cooperating with a flange 33. The reinforcement element improves the crimp, "protects" the gasket during crimping and reduces deformation of the relatively soft gasket.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

It is understandable that various modifications and/or improvements obvious to the skilled craftsman can be made to the different methods described in this description. In particular, reference is made to the reversal of steps provided this is not incompatible. It is also possible to provide neutral distal parts that can be coupled regardless of the corresponding distal part to be coupled.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

The invention claimed is:

1. An assembly of an electric cable and a cable terminal, comprising:

the cable being provided with an outer insulation sheath and at least one conductive strand, and having a sheathed portion and a stripped portion, the assembly further having a gasket with a sealing portion and a shrinkage portion, the shrinkage portion includes a collar, the terminal having shrinkage wings, and wherein the sealing portion of the gasket is assembled on the sheathed portion of the cable, the shrinkage portion of the gasket is assembled directly onto the stripped portion of the cable, wherein the shrinkage portion has a shoulder arranged to abut the sheathed portion of the cable, and the shrinkage wings are fully assembled onto and into direct engagement with the shrinkage portion of the gasket, the shrinkage wings arranged between the collar and the sealing portion along a longitudinal axis.

2. The assembly according to claim 1, wherein the shrinkage wings do not overlap when crimped onto the shrinkage portion of the gasket.

3. The assembly according to claim 1, wherein the terminal has one of a distal male part or a distal female part.

4. A method for crimping a cable terminal onto an electric cable, comprising:

providing an electrical cable having an outer insulation sheath and at least one conductive strand, with a sheathed portion, providing a terminal having shrinkage wings and provide a gasket having a sealing portion and a shrinkage portion, the shrinkage portion includes a collar, stripping the electrical cable so that a stripped portion is formed, positioning the shrinkage portion of the gasket so that it directly overlaps the stripped portion of the cable, without the shrinkage portion overlapping the sheathed portion of the cable, and fully crimping the shrinkage wings into direct engagement onto the shrinkage portion of the gasket without the shrinkage wings covering the sheathed portion of the cable, the shrinkage wings arranged between the collar and the sealing portion along a longitudinal axis.

5. The method according to claim 4, comprising positioning the sealing portion of the gasket at the sheathed portion of the cable without the sealing portion of the gasket covering the stripped portion of the cable.

6. The method according to claim 4, comprising completely crimping the shrinkage wings onto the crimping portion of the gasket without overlapping the shrinkage wings.

7. The method according to claim 4, wherein the step of stripping the electrical cable so as to form a stripped portion, is replaced by the step of supplying the electrical cable with the stripped portion.

8. The method according to claim 4, comprising abutting a shoulder of the shrinkage portion of the gasket on the sheathed portion of the cable.

* * * * *